US011334015B2

(12) United States Patent
Itabashi

(10) Patent No.: US 11,334,015 B2
(45) Date of Patent: May 17, 2022

(54) SHEET CONVEYANCE APPARATUS AND IMAGE FORMING APPARATUS

(71) Applicant: CANON KABUSHIKI KAISHA, Tokyo (JP)

(72) Inventor: Toshifumi Itabashi, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 274 days.

(21) Appl. No.: 16/442,929

(22) Filed: Jun. 17, 2019

(65) Prior Publication Data

US 2020/0012224 A1 Jan. 9, 2020

(30) Foreign Application Priority Data

Jul. 6, 2018 (JP) ..... JP2018-129520

(51) Int. Cl.

| | |
|---|---|
| ***B65H 5/06*** | (2006.01) |
| ***B65H 3/06*** | (2006.01) |
| ***G03G 15/00*** | (2006.01) |

(52) U.S. Cl.

CPC ..... *G03G 15/6529* (2013.01); *B65H 3/0607* (2013.01); *B65H 5/06* (2013.01)

(58) Field of Classification Search

CPC . B65H 5/06; B65H 5/062; B65H 3/06; B65H 3/0684; B65H 3/0607; B65H 3/0638; B65H 3/0669; B65H 2601/324; G03G 15/6529

See application file for complete search history.

(56) References Cited

U.S. PATENT DOCUMENTS

| | | | |
|---|---|---|---|
| 8,238,778 | B2 | 8/2012 | Itabashi et al. |
| 8,979,088 | B2 | 3/2015 | Itabashi |

FOREIGN PATENT DOCUMENTS

| | | | |
|---|---|---|---|
| JP | H09-240852 | A | 9/1997 |
| JP | 2009269686 | A * | 11/2009 |

* cited by examiner

*Primary Examiner* — Luis A Gonzalez
(74) *Attorney, Agent, or Firm* — Venable LLP

(57) ABSTRACT

A sheet conveyance apparatus includes a shaft portion, a roller member, and a guide member. The roller member includes a hole portion with an opening through which the shaft portion is fitted with the hole portion. At least a part of the guide member is located upstream of an end of the shaft portion in an attaching direction of the roller member. A distance between rotation axes of the roller member and the shaft portion is smaller than a difference between a radius of the opening and a radius of the end of the shaft portion in a state where an outer circumferential surface of the roller member is in contact with the guide member at a position upstream of the end of the shaft portion in the attaching direction.

20 Claims, 7 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus configured to convey a sheet and an image forming apparatus including the same.

Description of the Related Art

There is known a sheet conveyance apparatus, in an image forming apparatus such as a printer, configured to convey a sheet one by one using a feed roller to which power is applied in a rotation direction for conveying the sheet and using a retard roller to which power is applied in an opposite rotation direction against the direction in which the sheet is conveyed. Because the feed roller and the retard roller are worn away by rubbing with sheets, the rollers are required to be exchanged regularly in such image forming apparatus. Hitherto, in order to improve workability in exchanging the feed roller, Japanese Patent Application Laid-open No. H09-240852 proposes a sheet feeding unit configured to attach/detach a base member supporting the feed roller with respect to an apparatus body. When attaching the feed roller, this sheet feeding unit enables to attach the feed roller to the apparatus body by inserting the base member along a guide rail extending within the apparatus body through an opening of the apparatus body after fitting the feed roller to the base member. This arrangement makes it possible to readily attach the feed roller to a rotation shaft, which is disposed in the apparatus body and is thereby less visible, because it is not necessary to align an axis of the feed roller to that of the rotation shaft.

However, the attaching work of the sheet feeding unit disclosed in Japanese Patent Application Laid-open No. H09-240852 is complicated because it requires steps of fitting the feed roller to the base member and of attaching the base member to the apparatus body for attaching the feed roller to the apparatus body. Still further, this sheet feeding unit is configured such that the feed roller is fitted to the base member by sandwiching both ends of the feed roller by side walls of the base member. Due to that, an operator is required to elastically deform the side walls of the base member in fitting the feed roller to the base member. That is, the sheet feeding unit has a problem in terms of workability in attaching the feed roller.

SUMMARY OF THE INVENTION

The present invention provides a sheet conveyance apparatus capable of improving workability in attaching a roller member and an image forming apparatus having the same.

According to one aspect of the invention, a sheet conveyance apparatus includes a shaft portion supported by an apparatus body; a roller member including an outer circumferential surface to contact the sheet and a hole portion, having an opening, to which the shaft portion is fitted, wherein the roller member is attached to the shaft portion through the opening along an axial line of the shaft portion; and a guide member configured to guide the roller member in an attachment operation of the roller member to the shaft portion, wherein at least a part of the guide member is located upstream of an end of the shaft portion in an attaching direction of the roller member, and wherein the guide member is configured to guide the roller member such that the end of the shaft portion is located inside the opening of the roller member when viewed in the attaching direction in a state where the outer circumferential surface of the roller member is in contact with the guide member at a position upstream of the end of the shaft portion in the attaching direction.

According to another aspect of the invention, an image forming apparatus includes: a sheet conveyance apparatus configured to convey a sheet; and an image forming portion configured to form an image on the sheet conveyed by the sheet conveyance apparatus. The sheet conveyance apparatus includes: a shaft portion supported by an apparatus body; a roller member including an outer circumferential surface to contact the sheet and a hole portion, having an opening, to which the shaft portion is fitted, wherein the roller member is attached to the shaft portion through the opening along an axial line of the shaft portion; and a guide member configured to guide the roller member in an attachment operation of the roller member to the shaft portion, wherein at least a part of the guide member is located upstream of an end of the shaft portion in an attaching direction of the roller member, and wherein the guide member is configured to guide the roller member such that the end of the shaft portion is located inside the opening of the roller member when viewed in the attaching direction in a state where the outer circumferential surface of the roller member is in contact with the guide member at a position upstream of the end of the shaft portion in the attaching direction.

Further features of the present invention will become apparent from the following description of exemplary embodiments with reference to the attached drawings.

DESCRIPTION OF THE EMBODIMENTS

Now, exemplary embodiments of the invention will be described with reference to the drawings.

First Embodiment

A first embodiment of a sheet conveyance apparatus and an image forming apparatus including the same will be described with reference to FIGS. 1 through 4C. The image forming apparatus of the present disclosure is what includes the sheet conveyance apparatus capable of feeding sheets such as a copier, a printer, a facsimile and a multi-function printer. In the following embodiment, a printer 100 will be described as one exemplary image forming apparatus. The sheet may be a thin recording medium such as a sheet of paper, a sheet of an envelope, a plastic film for use in an overhead projector (overhead projector transparency) or a cloth. Note that in the following description, positional relationships of up and down, right and left and front and rear will be expressed based on a state in which the printer 100 is viewed from the front side, i.e., from a point of view of FIG. 1.

Schematic Configuration of Printer

Figure 1:
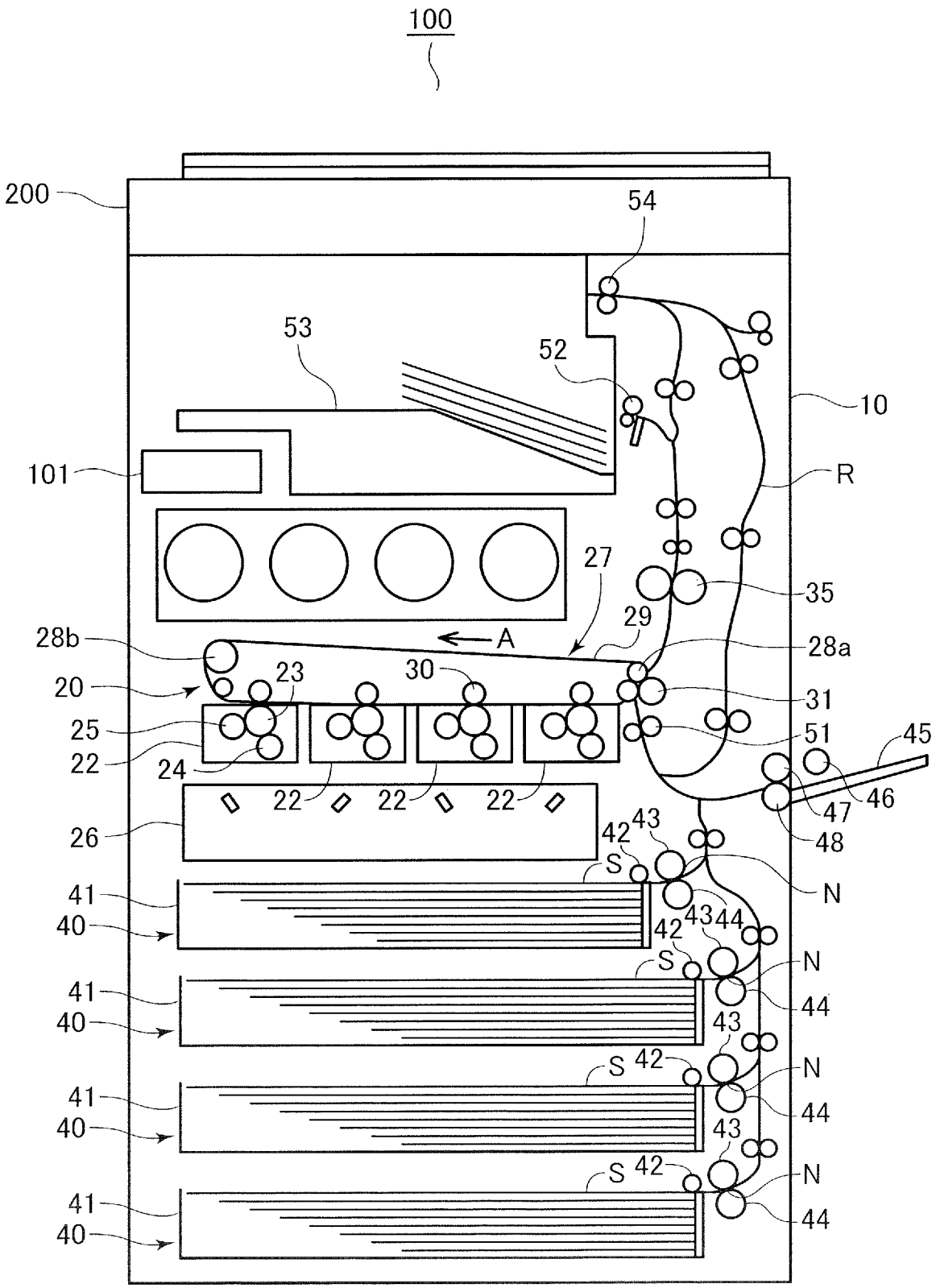
FIG. 1 is a schematic diagram illustrating a configuration of a printer of a first embodiment.

The printer 100 of the present embodiment is an electrophotographic full-color laser beam printer. As illustrated in FIG. 1, the printer 100 includes an image reading apparatus 200 configured to read an image of a document and a printer body 10. The printer body 10 includes a sheet feeding unit 40 serving as a sheet conveyance apparatus configured to feed a sheet stacked therein, an image forming unit 20 forming an image on the sheet, a fixing portion 35 fixing a toner image onto the sheet, and a control portion 101. When an instruction of forming an image is transmitted to the printer 100, an image forming process of the image forming unit 20 is started based on image information received from the image reading apparatus 200 or from an external computer or the like connected to the printer 100. The control portion 101 controls the following image forming process and sheet feeding process.

The image forming unit 20 adopts a four-drum full-color system, which includes a laser scanner 26 and four process cartridges 22 for forming four color toner images of yellow (Y), magenta (M), cyan (C) and black (K). Each of the process cartridges 22 includes a photosensitive drum 23, a charger 24, a developer 25 and a cleaner not illustrated. The laser scanner 26 irradiates the photosensitive drum 23 with a laser beam based on the inputted image information. The photosensitive drum 23 has been charged in advance by the charger 24 and is irradiated with the laser beam to form an electrostatic latent image on the photosensitive drum 23. After that, the electrostatic latent image is developed by the developer 25 to form a toner image on the photosensitive drum 23.

An intermediate transfer unit 27 is disposed above the process cartridges 22. The intermediate transfer unit 27 includes a driving roller 28*a*, a tension roller 28*b* and an intermediate transfer belt 29 wrapped around the driving roller 28*a* and the tension roller 28*b* and being in contact with the respective photosensitive drums 23. The intermediate transfer unit 27 also includes four primary transfer rollers 30 in contact with an inner surface of the intermediate transfer belt 29 at positions facing the respective photosensitive drums 23 and a secondary transfer roller 31 in contact with an outer surface of the intermediate transfer belt 29 at a position facing the driving roller 28*a*.

In the image forming process, the toner images of the respective toners formed on the respective photosensitive drums 23 are superimposed and transferred onto the intermediate transfer belt 29 by the respective primary transfer rollers 30. Thereby, a color image is formed on the intermediate transfer belt 29. The superimposed and transferred toner image is conveyed to the secondary transfer roller 31 by the intermediate transfer belt 29 rotated by the driving roller 28*a*.

In parallel with the abovementioned image forming process, a sheet S is fed from the sheet feeding unit 40. A pickup roller 42 of the sheet feeding unit 40 feeds the sheet S stacked on a plurality of sheet cassettes 41 configured to be drawable in the forward direction out of the printer body 10. The sheet S fed by the pickup roller 42 is separated one by one at a nip portion N, where a retard roller 44 is in contact with the feed roller 43 and applies frictional force to sheets entering the nip portion N, and is conveyed to a registration roller pair 51. The retard roller 44 is one example of a conveyance roller involved in conveyance of the sheet. Still further, a manual feed tray 45 capable of stacking a sheet is pivotally supported in the printer body 10. The sheet supported by the manual feed tray 45 is fed by being separated one by one by a pickup roller 46, a feed roller 47 and a retard roller 48 and is then conveyed to the registration roller pair 51.

The toner image on the intermediate transfer belt 29 is transferred by the secondary transfer roller 31 onto the sheet S whose skew has been corrected by the registration roller pair 51 and which has been conveyed at predetermined conveyance timing. The sheet S onto which the toner image has been transferred is applied with predetermined heat and pressure at the fixing portion 35 to melt and fix toner. The sheet S which has passed through the fixing portion 35 is discharged by a discharge roller pair 52 onto a discharge tray 53. In a case of forming images on both surfaces of the sheet S, the sheet S in which a toner image has been formed on a first surface thereof is conveyed to a reverse roller pair 54 to be conveyed in a reverse conveyance path R in a condition in which front and back surfaces are reversed as well as leading and trailing edges. The sheet S is then conveyed to the registration roller pair 51 again, and a toner image is transferred onto a second surface of the sheet by the secondary transfer roller 31.

Detailed Configuration of Sheet Feeding Unit

Figure 2:
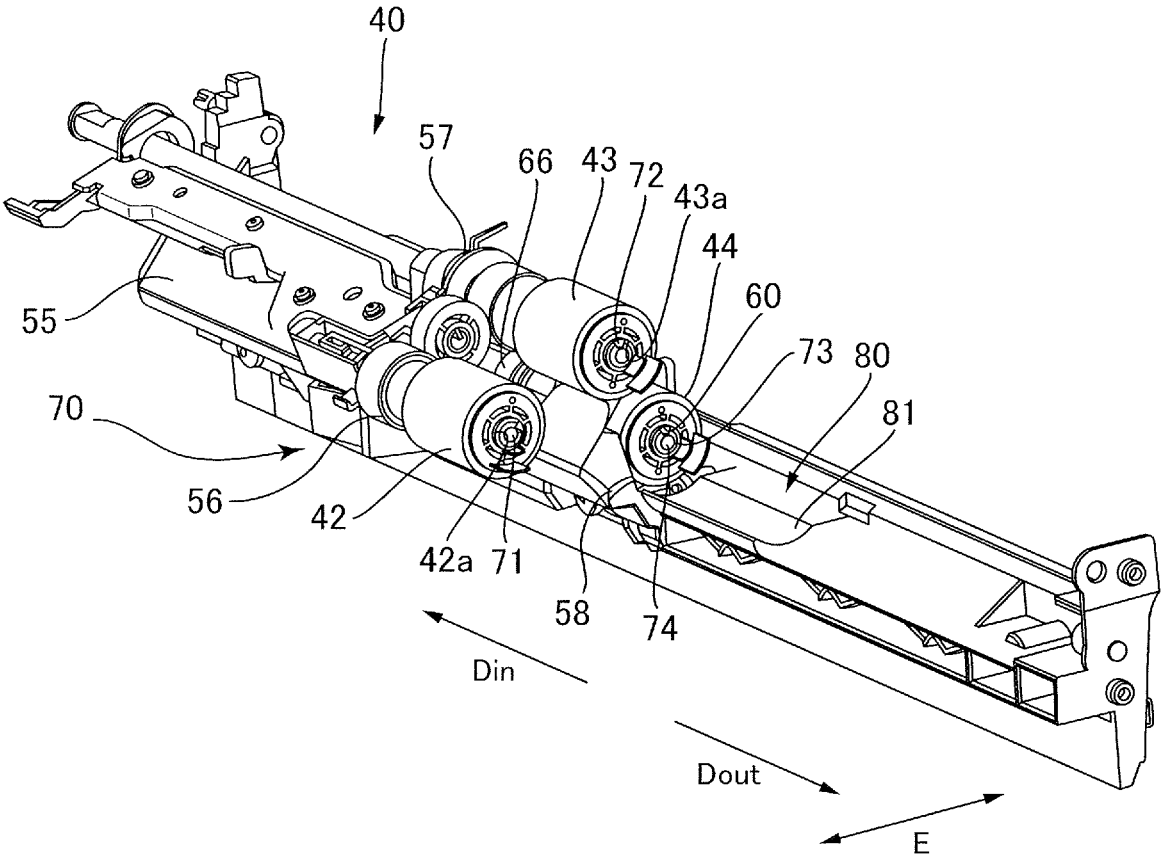
FIG. 2 is a perspective view illustrating a pickup roller, a feed roller and a retard roller.

As illustrated in FIG. 2, the sheet feeding unit 40 includes a rotation shaft 72, a pickup holder 55 swingably supported on the rotation shaft 72, a rotation shaft 71 rotatably supported by the pickup holder 55, and a motor M1 inputting drive to the rotation shaft 72. The feed roller 43 is rotatably supported by the rotation shaft 72, and the pickup roller 42 is rotatably supported by the rotation shaft 71. Rotation of the rotation shaft 72 is transmitted to the rotation shaft 71 via a gear train 56. A torsion coil spring 57 whose one end is connected with the pickup holder 55 is idly fitted on the rotation shaft 72, and a coil portion of the torsion coil spring 57 gets tightened as the rotation shaft 72 is rotated by the motor M1. This arrangement makes it possible to transmit rotation of the rotation shaft 72 also to the pickup holder 55, and the pickup roller 42 drops together with the pickup holder 55.

Upstream ends of the rotation shafts 71 and 72 in a forward direction "Dout", i.e., in a draw-out direction, are supported by the pickup holder 55 and a frame portion 70, thereby the upstream ends of the shafts being fixed ends. Then, the rotation shafts 71 and 72 extend downstream in the forward direction "Dout" from the fixed ends such that downstream ends of the shafts in the forward direction "Dout" are free ends. The respective rotation shafts 71 and 72 are inserted into insertion holes 42*a* and 43*a* of the pickup roller 42 and the feed roller 43. The pickup roller 42 and the feed roller 43 can be pulled out of the free ends of the rotation shafts 71 and 72 in the forward direction "Dout". The pickup roller 42 and the feed roller 43 are also configured to be pushed in from the free ends of the rotation shaft 71 and 72 in a rearward direction "Din" opposite to the forward direction "Dout". The rearward direction "Din" is an attaching direction of the present embodiment.

Still further, the sheet feeding unit 40 includes a separation holder 58 movably supported by the frame portion 70, a rotation shaft 73 rotatably supported by the separation holder 58 and a retard roller 44 rotatably supported on the rotation shaft 73. The rotation shaft 73 has one end, i.e., an upstream end in the forward direction "Dout", elevetably supported as a fixed end by the separation holder 58. The rotation shaft 73 extends downstream in the forward direction "Dout" from the fixed end such that a downstream end in the forward direction "Dout", i.e., upstream end in the attaching direction, is a free end 74. That is, the rotation shaft 73 serving as a shaft portion is cantilevered by the frame portion 70 serving as the apparatus body through the separation holder 58. The rotation shaft 73 is inserted into an insertion hole 60 serving as a communication hole of the retard roller 44 and is drawable from the free end 74 in the forward direction "Dout". The retard roller 44 is also configured to be pushed in the rearward direction "Din" from the free end 74. The rotation shaft 73 is provided with a torque limiter 66, and a driving force of the motor M1 is applied to the rotation shaft 73 through the torque limiter 66 by being connected with the torque limiter 66.

In a case where the sheet cassette 41 is inserted into the printer body 10, the rotation shaft 73 is urged upward through the separation holder 58 by an urging portion not illustrated, and the retard roller 44 forms a nip portion N between the feed roller 43. Meanwhile, in a case where the sheet cassette 41 is drawn out of the printer body 10, the separation holder 58 drops by a separating mechanism not illustrated, and the retard roller 44 is separated from the feed roller 43.

Figure 3:
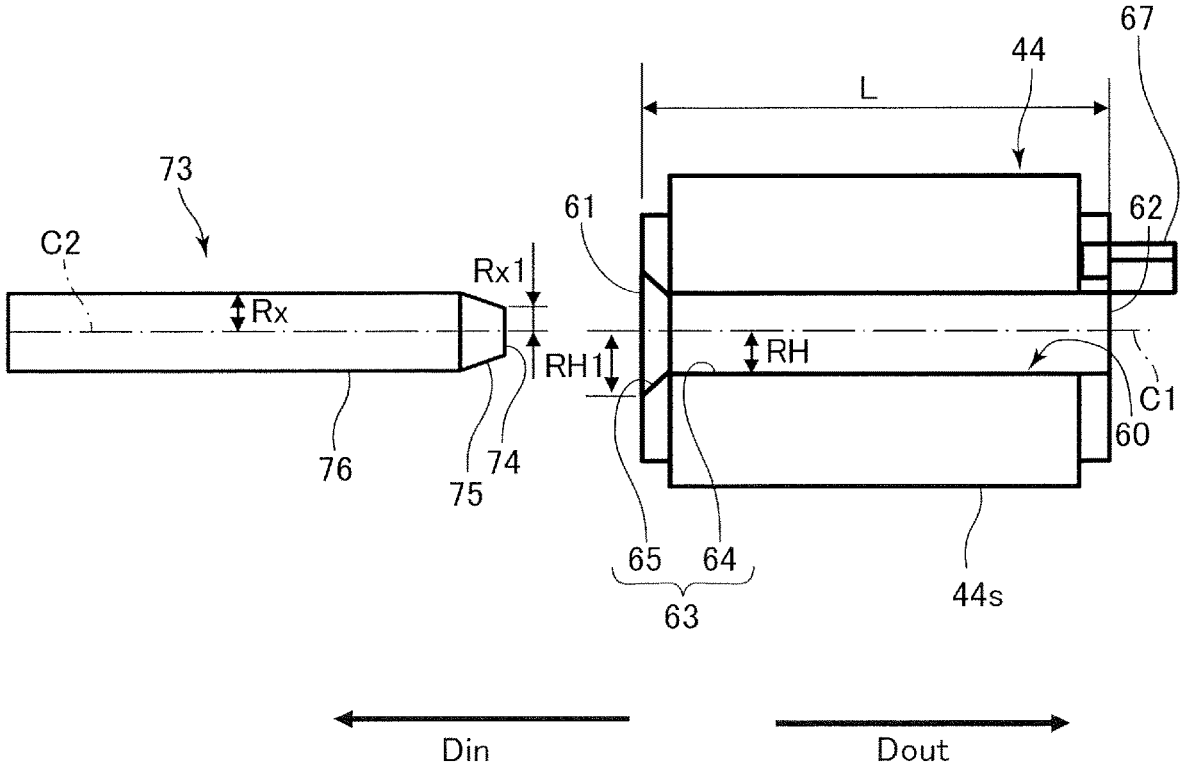
FIG. 3 is a section view of the retard roller and a rotation shaft.

FIG. 3 is a section view illustrating the retard roller 44 and the rotation shaft 73. The retard roller 44 includes an outer circumferential surface 44*s* to be in contact with a sheet at the nip portion N, opening ends 61 and 62 defined respectively at upstream and downstream ends in the forward direction "Dout" of the retard roller 44, i.e., downstream and upstream ends in the attaching direction, and a communicating hole portion 63 defining the insertion hole 60 communicating from the opening end 61 to the opening end 62 as an opening. The communicating hole portion 63 which is a hole portion of the present embodiment includes a cylinder portion 64 formed into a cylindrical shape having a constant radius and a hole-side tapered portion 65 extending from the upstream end to the opening end 61 in the forward direction "Dout" of the cylinder portion 64 as a tapered portion defined such that the closer the opening end 61, the larger the radius is, i.e., an inner diameter is enlarged. That is, the insertion hole 60 is formed such that a radius RH1 of the opening end 61 provided at the downstream end in the attaching direction is greater than a radius RH of the cylinder portion 64.

The rotation shaft 73 also includes a columnar portion 76 extending in the forward direction "Dout" while keeping a radius thereof constant from the fixed end and a shaft-side tapered portion 75 extending from a downstream end in the forward direction "Dout" of the columnar portion 76 to the free end 74 and defined such that the closer the free end 74, the smaller the radius is, i.e., the outer diameter is reduced. That is, the rotation shaft 73 is formed such that a radius Rx1 of the free end 74 is smaller than the radius Rx of the columnar portion 76.

Figure 4A:
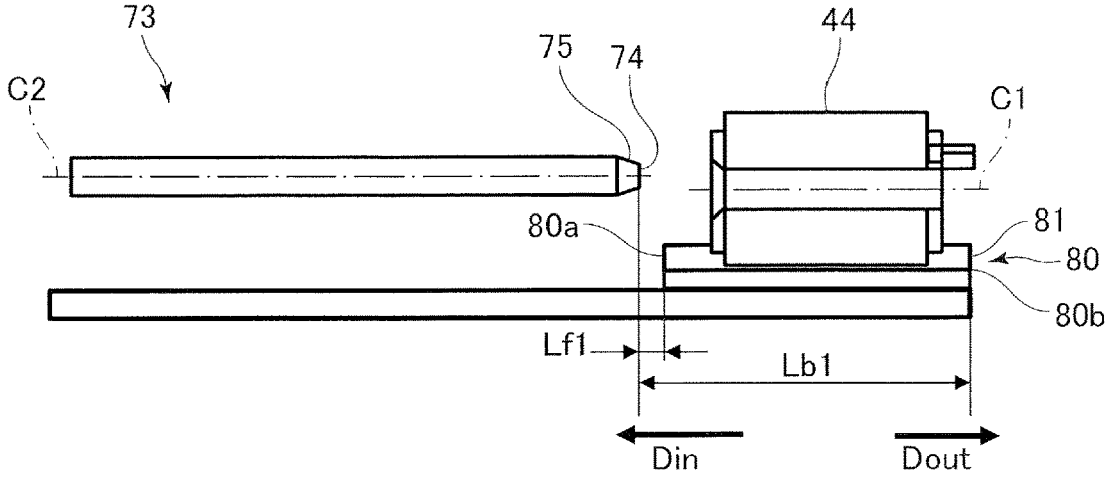
FIG. 4A is a section view illustrating a roller supporting portion, the retard roller and the rotation shaft.
Figure 4B:
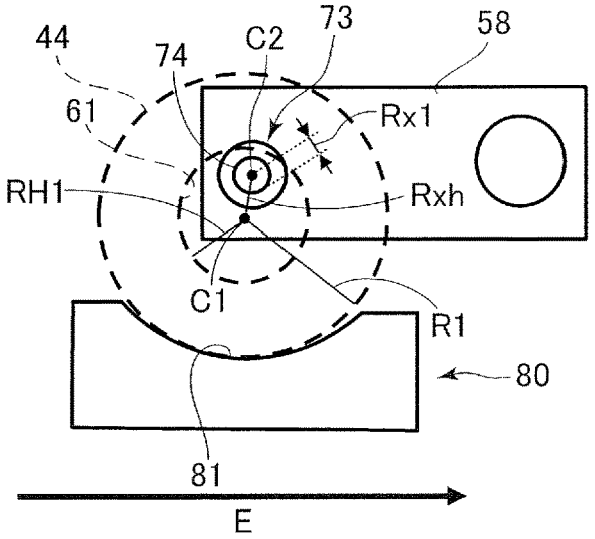
FIG. 4B is a side view of the roller supporting portion viewed from downstream in a forward direction.
Figure 4C:
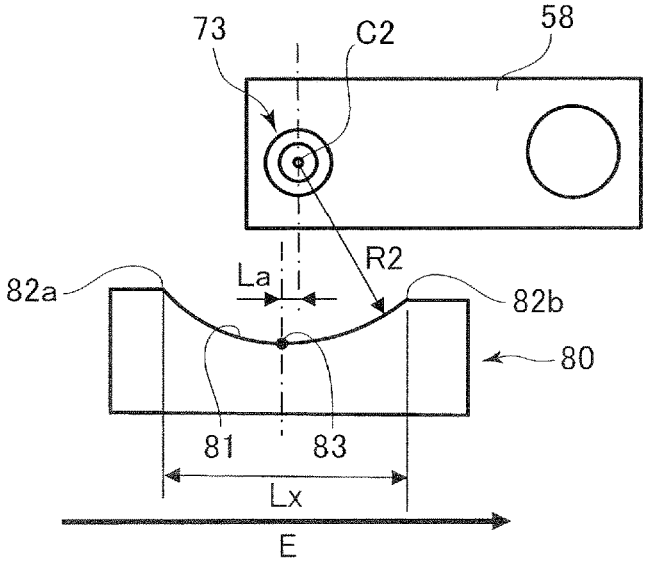
FIG. 4C is a side view of the roller supporting portion from which the retard roller is removed viewed from downstream in the forward direction.

As illustrated in FIG. 2, the separation holder 58 to support the retard roller 44 is provided with a roller supporting base 80. The separation holder 58 is arranged below the free end 74 in the gravity direction and downstream in the forward direction "Dout". As illustrated in FIGS. 4A, 4B and 4C, the roller supporting base 80 serving as a guide member of the present embodiment includes a roller placing surface 81 serving as a roller supporting portion formed into a concave surface, curved along an outer circumferential surface of the retard roller 44 when viewed from downstream in the forward direction "Dout". The roller placing surface 81 is particularly formed into a circular arc having a diameter larger than the outer diameter of the retard roller 44 in the illustrated example. The roller supporting base 80 is configured such that the retard roller 44 pulled out of the rotation shaft 73 can be placed on the roller placing surface 81.

Here, a positional relationship among the rotation shaft 73, the roller placing surface 81 and the retard roller 44 supported by the roller placing surface 81 will be described in detail. As illustrated in FIG. 4A, the roller placing surface 81 is disposed such that the upstream end 80*a* in the forward direction "Dout" of the roller placing surface 81 is disposed to be located downstream in the forward direction "Dout" of the free end 74. The roller placing surface 81 is disposed such that a distance Lf1 between the upstream end 80*a* and the free end 74 in the forward direction "Dout" is shorter than a half of a roller width L (see FIG. 3) which is a length of the retard roller 44 in the forward direction "Dout", i.e., Lf1<L/2. Still further, the roller placing surface 81 is formed such that a distance Lb1 in the forward direction "Dout" between the downstream end 80*b* and the free end 74 in the forward direction "Dout" is longer than the roller width L, i.e., Lb1>L.

As illustrated in FIGS. 4B and 4C, the roller placing surface 81 is disposed such that a distance R2 between a rotation axis C2 of the rotation shaft 73 and the roller placing surface 81 when viewed from downstream in the forward direction "Dout" is longer than a radius R1 of the retard roller 44, i.e., R2>R1. That is, the roller placing surface 81 is disposed such that the rotation axis C1 of the retard roller 44 supported by the roller placing surface 81 is located under the rotation axis C2 of the rotation shaft 73 in the gravity direction. Still further, when the retard roller 44 is supported on the roller placing surface 81, a distance Rxh from the rotation axis C1 to the rotation axis C2 is smaller than a difference between the radius RH1 and a radius Rx1. That is, the roller placing surface 81 is disposed so as to meet the following expression (1);

$$Rxh < RH1 - Rx1 \quad (1)$$

Still further, a distance La in a sheet feed direction E as an orthogonal direction orthogonal to the forward direction "Dout" from a lowest portion 83 of the roller placing surface 81 to the rotation axis C2 is equal to or less than a radius Rx (La≤Rx). That is, the roller placing surface 81 is disposed such that the distance La in the sheet feed direction E between the rotation axis C1 of the retard roller 44 supported by the roller placing surface 81 and the rotation axis C2 of the rotation shaft 73 is equal to or less than the radius Rx. Then, the roller placing surface 81 is disposed such that the distance La is equal to or less than the difference between the radius RH1 and the radius Rx (La≤RH1−Rx). Then, the roller placing surface 81 is disposed such that a distance between an upstream end 82*a* and a downstream end 82*b* in the sheet feed direction E of the roller placing surface 81, i.e., a distance Lx between both ends in the sheet feed direction E of the roller placing surface 81, is equal to or more than the radius Rx (Lx≥Rx). Note that the distance Lx is preferable to be twice or more of the radius Rx.

Because the sheet feeding unit 40 is constructed as described above, a user draws the sheet cassette 41 out of the printer body 10 at first in exchanging the retard roller 44. Thereby, the rotation shaft 73 drops and the retard roller 44 is spaced away from the feed roller 43. After that, the user operates a locking hook 67 serving as a manipulating portion that restricts movement of the retard roller 44 in the forward direction "Dout" to disengage from the rotation shaft 73 (see FIG. 3). Then, the user can pull the retard roller 44 out of the rotation shaft 73 by pulling the retard roller 44 in the forward direction "Dout".

In a case where the user attaches the retard roller 44 to the rotation shaft 73, the user places the retard roller 44 on the roller placing surface 81 at first. Because the retard roller 44 is disposed with respect to the rotation shaft 73 so as to meet the expression (1), the opening end 61 overlaps with the free end 74 when viewed in the forward direction "Dout". That is, in a case where the outer circumferential surface of the roller member is in contact with the guide member (80) at a position upstream of the upstream end of the shaft portion in the attaching direction ("Din"), the upstream end (74) of the shaft portion is located inside the opening (61) of the roller member (see FIG. 4B). Then, the free end 74 enters the opening end 61 when the user pushes the retard roller 44 in the rearward direction "Din" opposite to the forward direction "Dout". Then, as the user pushes the retard roller 44 to a predetermined position, the retard roller 44 is fitted to the rotation shaft 73 guided along the hole-side tapered portion 65 and the shaft-side tapered portion 75 and is connected with the torque limiter 66.

Thus, the user can fit the retard roller 44 onto the rotation shaft 73 just by sliding the retard roller 44 in the rearward direction "Din" in a condition in which the retard roller 44 is supported on the roller placing surface 81. In that operation, the retard roller 44 is automatically aligned with the rotation shaft 73. Due to that, the user is not required to align the opening end 61 with the free end 74 in fitting the retard roller 44, improving workability of the attaching operation.

Still further, because the hole-side tapered portion 65 and the shaft-side tapered portion 75 are provided on the retard roller 44 and the rotation shaft 73 in the present printer 100, a tolerance regarding a gap of the rotation axis C1 and the rotation axis C2 in fitting the rotation shaft 73 with the insertion hole 60 is broadened. This makes it possible to more readily attach the retard roller 44 to the rotation shaft 73.

In the present printer 100, the sheet feed portion 40 is also configured such that the rotation axis C1 of the retard roller 44 supported on the roller placing surface 81 is located below the rotation axis C2 of the rotation shaft 73. This arrangement makes it possible to attach the retard roller 44 to the rotation shaft 73 while slightly floating above the roller placing surface 81. Due to that, this arrangement makes it also possible to prevent the retard roller 44 from being forcibly pressed against the roller placing surface 81, thereby suppressing increase in resistance against the attaching direction in attaching the retard roller 44. This arrangement makes it also possible to smoothly remove the retard roller 44 without interfering between the retard roller 44 and the roller placing surface 81 in removing the retard roller 44.

Still further, because the distance Lf1 is configured to be shorter than a half of the roller width L, a position of the gravity of the retard roller 44 is located downstream of the upstream end 80*a* of the roller placing surface 81 in the forward direction "Dout" just before when the free end 74 is inserted into the opening end 61. This arrangement makes it possible to prevent the retard roller 44 from slipping down between the free end 74 and the roller placing surface 81 in attaching/detaching the retard roller 44 to/out of the rotation shaft 73.

The distance Lb1 is longer than the roller width L as described above. In other words, the upstream end (80*b*) in the attaching direction "Din" of the guide member extends upstream in the attaching direction to a position (Lb1) farther than the upstream end (74) of the shaft portion in the attaching direction by the length (L) of the roller member in the attaching direction or more. Due to that, the gravity center position of the retard roller 44 just before when the free end 74 is inserted into the opening end 61 is located upstream of the downstream end 80*b* of the roller placing surface 81 in the forward direction "Dout". This arrangement makes it possible to prevent the retard roller 44 from slipping down on a downstream side of the roller placing surface 81 in the forward direction "Dout" in attaching/detaching the retard roller 44 to/out of the rotation shaft 73.

Still further, the roller placing surface 81 is disposed such that the distance La is less than the difference between the radius RH1 and the radius Rx. This arrangement makes it possible to prevent the gap of the rotation axis C1 and the rotation axis C2 in the sheet feed direction E from exceeding the tolerance by which the rotation shaft 73 can be inserted into the insertion hole 60 in attaching the retard roller 44 on the roller placing surface 81.

Still further, because the roller placing surface 81 is constructed such that the distance Lx is greater than the radius Rx, the retard roller 44 can be stably attached on and can be reduced from falling down out of the roller placing surface 81 in the sheet feed direction E. Because the roller placing surface 81 is constructed also such that the distance La is less than the radius Rx, there is a possibility that the retard roller 44 moves by the radius Rx in maximum in the sheet feed direction E in fitting the retard roller 44 to the rotation shaft 73. For instance, in a case where the distance Lx is twice or more of the radius Rx, it is possible to prevent the gravity center position of the retard roller 44 from moving outside of the roller placing surface 81 over the upstream end 82*a* in fitting the retard roller 44 to the rotation shaft 73. Still further, even if the retard roller 44 moves downstream in the sheet feed direction E in fitting to the rotation shaft 73, it is possible to prevent the gravity center position of the retard roller 44 from moving outside of the roller placing surface 81 over the downstream end 82*b*. This arrangement makes it possible to prevent the retard roller 44 from falling out of the roller placing surface 81 in the printer 100.

Second Embodiment

Figure 5A:
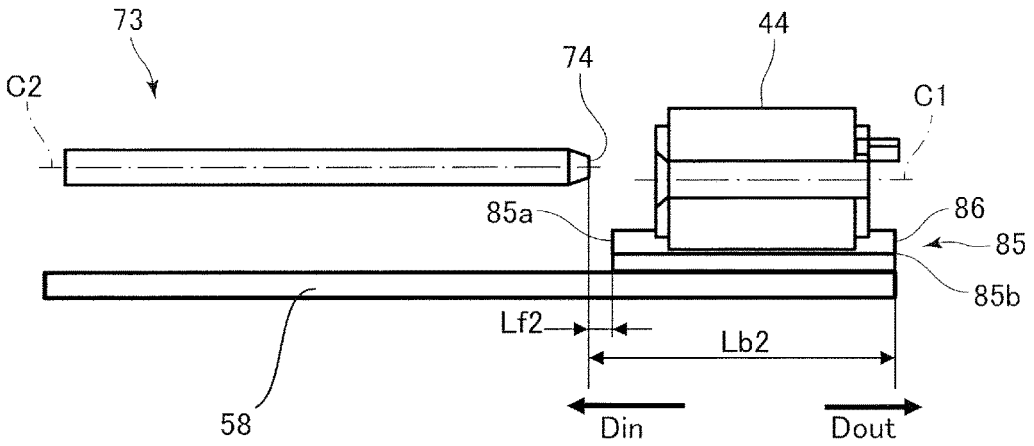
FIG. 5A is a section view illustrating a roller supporting portion of a second embodiment.
Figure 5B:
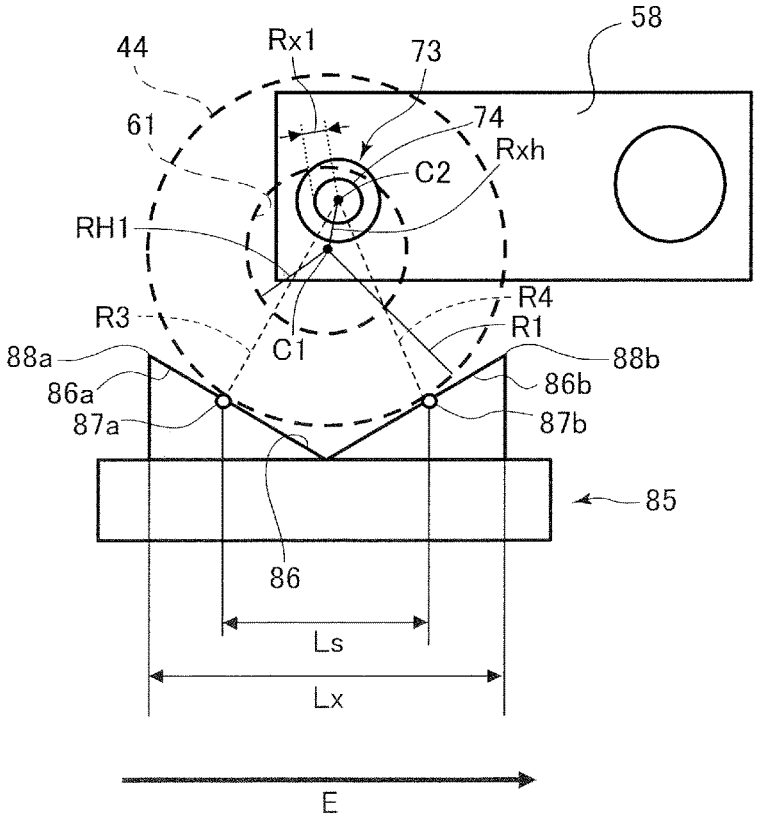
FIG. 5B is a side view of a roller supporting portion supporting a retard roller on a roller placing surface viewed from downstream in the forward direction.

Next, a second embodiment of the sheet conveyance apparatus will be described. Note that the same components with those of the first embodiment will not be illustrated or denoted by the same reference numerals while omitting their description. As illustrated in FIGS. 5A and 5B, the separation holder 58 is provided with a roller supporting base 85 capable of supporting the retard roller 44 and formed under the free end 74 and downstream in the forward direction "Dout". The roller supporting base 85 serving as a guide member of the present embodiment has a roller placing surface 86 serving as a roller supporting portion formed into a shape of V when viewed from downstream in the forward direction "Dout". The roller placing surface 86 stably supports the retard roller 44 by coming into contact at contact points 87*a* and 87*b* at different positions in a direction intersecting with the forward direction "Dout" with respect to the retard roller 44 in a condition of being pulled out of the rotation shaft 73. That is, the guide member of the present embodiment includes a first surface 86*a* provided with the contact point 87*a*, i.e., a first contact portion of the present embodiment, and a second surface 86*b* provided with the contact point 87*b*, i.e., a second contact portion of the present embodiment.

Here, a positional relationship among the rotation shaft 73, the roller placing surface 86 and the retard roller 44 when supported by the roller placing surface 86 will be described in detail. As illustrated in FIG. 5A, the roller placing surface 86 is disposed such that an upstream end 85*a* in the forward direction "Dout" of the roller placing surface 86 is located downstream in the forward direction "Dout" of the free end 74. The roller placing surface 86 is disposed such that a distance Lf2 in the forward direction "Dout" between the upstream end 85*a* and the free end 74 is shorter than a half of the roller width L, i.e., Lf2<L/2. The roller placing surface 86 is also formed such that a distance Lb2 in the forward direction "Dout" between a downstream end 85*b* and the free end 74 in the forward direction "Dout" is longer than the roller width L, i.e., Lb2>L.

As illustrated in FIG. 5B, the roller placing surface 86 is disposed such that a distance R3 between the rotation axis C2 and the contact point 87*a* and a distance R4 between the rotation axis C2 and the contact point 87*b* are longer than the radius R1, respectively, when viewed from downstream of the forward direction "Dout". That is, the roller placing surface 86 is disposed such that the rotation axis C1 of the retard roller 44 supported by the roller placing surface 86 is located under the rotation axis C2. The roller placing surface 86 is disposed so as to meet the abovementioned expression (1).

The roller placing surface 86 is also disposed so as to meet the following expression (2) in a relationship among the distance Ls between the contact point 87*a* and the contact point 87*b*, a distance Lx between the upstream end 88*a* and the downstream end 88*b* in the sheet feed direction E of the roller placing surface 86 and the radius Rx of the rotation shaft 73:

$$Rx<Ls\leq Lx \tag{2}$$

Because the sheet feeding unit 40 is constructed as described above, the user can fit the retard roller 44 with the rotation shaft 73 just by sliding the retard roller 44 in the rearward direction "Din" in a condition in which the retard roller 44 is supported on the roller placing surface 86. In that operation, the retard roller 44 and the rotation shaft 73 are automatically aligned. Due to that, the user is not required to align the opening end 61 with the free end 74 in attaching the retard roller 44 and attaching workability can be improved in the printer 100.

Still further, because the roller placing surface 86 is formed not into the cylindrical shape, i.e., into the circular arc when viewed in the axial direction, but into a V-shape formed of a plurality of planes, i.e., straight lines when viewed in the axial direction, the roller placing surface 86 can be readily processed as compared to that of the circular arc, and the manufacturing cost can be cut.

Third Embodiment

Figure 6A:
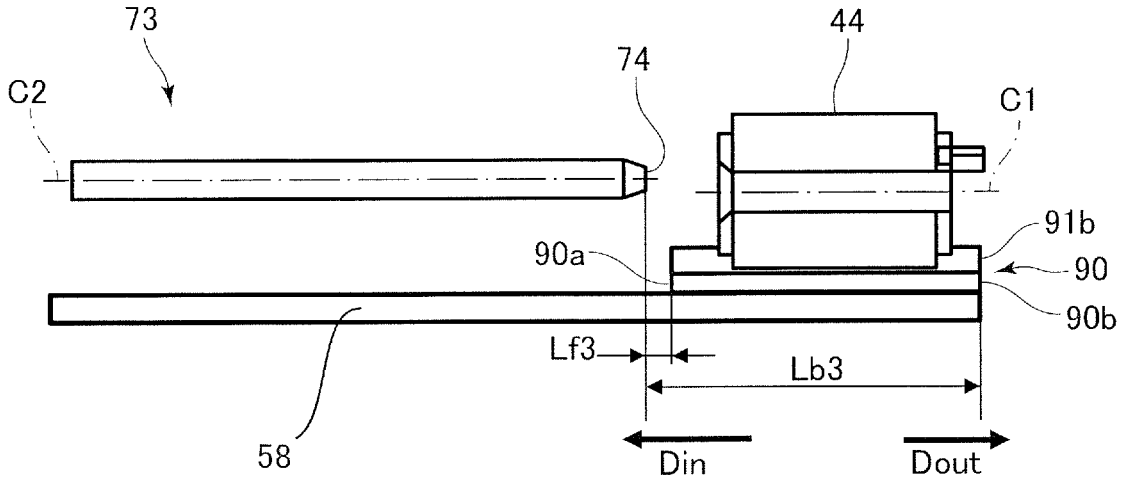
FIG. 6A is a section view illustrating a roller supporting portion of a third embodiment.
Figure 6B:
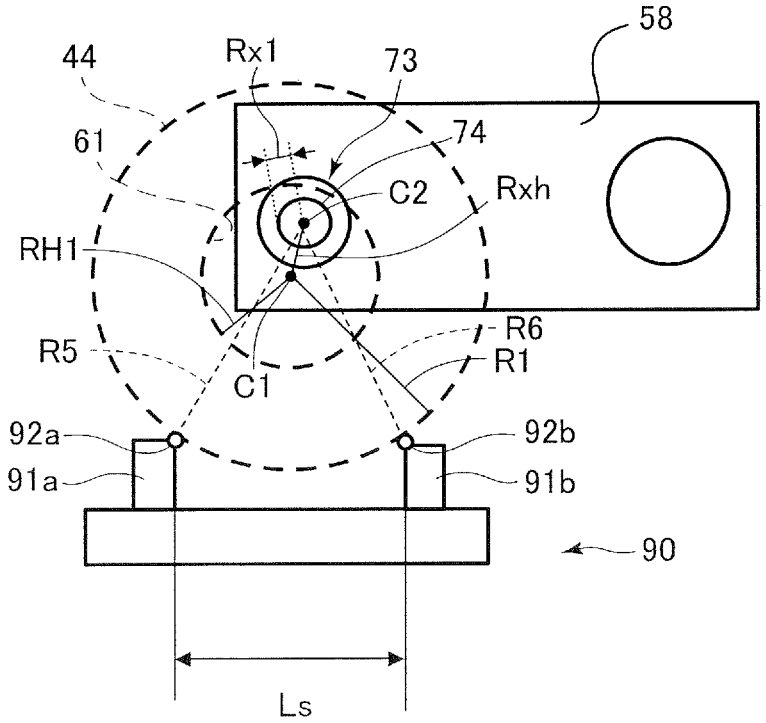
FIG. 6B is a side view of the roller supporting portion supporting a retard roller by first and second ribs viewed from downstream in the forward direction.

Next, a third embodiment of the sheet conveyance apparatus will be described. Note that the same components with those of the first and second embodiments will not be illustrated or denoted by the same reference numerals while omitting their description. As illustrated in FIGS. 6A and 6B, the separation holder 58 is provided with a roller supporting base 90 capable of supporting the retard roller 44 and formed under the free end 74 and downstream in the forward direction "Dout". The roller supporting base 90 has first and second ribs 91*a* and 91*b* disposed in parallel in the sheet feed direction E and serving as a roller supporting portion. The roller supporting base 90 is configured to support the retard roller 44 pulled out of the rotation shaft 73 by bringing the retard roller 44 in contact with a contact point 92*a* of the first rib 91*a* and with a contact point 92*b* of the second 91*b*. Note that a distance between the first and second ribs 91*a* and 91*b* is defined as a distance Ls between the contact point 92*a* and the contact point 92*b*. The first rib 91*a* is a first contact portion of the present embodiment and the second rib 91*b* is a second contact portion of the present embodiment.

Here, a positional relationship among the rotation shaft 73, the roller supporting base 90 and the retard roller 44 when supported by the first rib 91*a* and the second rib 91*b* will be described in detail. The first and second ribs 91*a* and 91*b* extend along the forward direction "Dout", and positions of upstream ends and downstream ends coincide in the forward direction "Dout" when viewed in the sheet feed direction E orthogonal to the forward direction "Dout". Therefore, upstream ends of these first and second ribs 91*a* and 91*b* in the forward direction "Dout" are both defined as an upstream end 90*a*, and downstream ends of these first and second ribs 91*a* and 91*b* in the forward direction "Dout" are both defined as a downstream end 90*b*.

As illustrated in FIG. 6A, the first and second ribs 91*a* and 91*b* are disposed such that the upstream end 90*a* in the forward direction "Dout" is disposed downstream of the free end 74 in the forward direction "Dout". The first and second ribs 91*a* and 91*b* are disposed such that a distance Lf3 between the upstream end 90*a* and the free end 74 is shorter than a half of the roller width L. Still further, the first and second ribs 91*a* and 91*b* are formed such that the distance Lb3 between the downstream end 90*b* and the free end 74 in the forward direction "Dout" is longer than the roller width L.

As illustrated in FIG. 6B, the first and second ribs 91*a* and 91*b* are disposed such that a distance R5 between the rotation axis C2 and the contact point 92*a* and a distance R6 between the rotation axis C2 and the contact point 92*b* are longer than the radius R1, respectively, when viewed from downstream in the forward direction "Dout". That is, the first and second ribs 91*a* and 91*b* are disposed such that the rotation axis C1 of the retard roller 44 supported by the first and second ribs 91*a* and 91*b* is located below the rotation axis C2. The first and second ribs 91*a* and 91*b* are also disposed to meet the abovementioned expression (1).

Because the sheet feeding unit 40 is constructed as described above, the user can insert the retard roller 44 into the rotation shaft 73 just by sliding the retard roller 44 in the rearward direction "Din" in a condition in which the retard roller 44 is supported on the first and second ribs 91*a* and 91*b*. At this time, the retard roller 44 and the rotation shaft 73 are automatically aligned. Due to that, the user is not required to align the opening end 61 with the free end 74 in fitting the retard roller 44, and the attaching workability can be improved in the printer 100.

Still further, the roller supporting base 90 is provided with the columnar first and second ribs 91*a* and 91*b* to support the retard roller 44. This arrangement makes it possible for the roller supporting base 90 to reduce a volume of parts supporting the retard roller 44 as compared to the cases of having the circular arc or the V-shaped roller placing surface and to cut the manufacturing cost.

Figure 7:
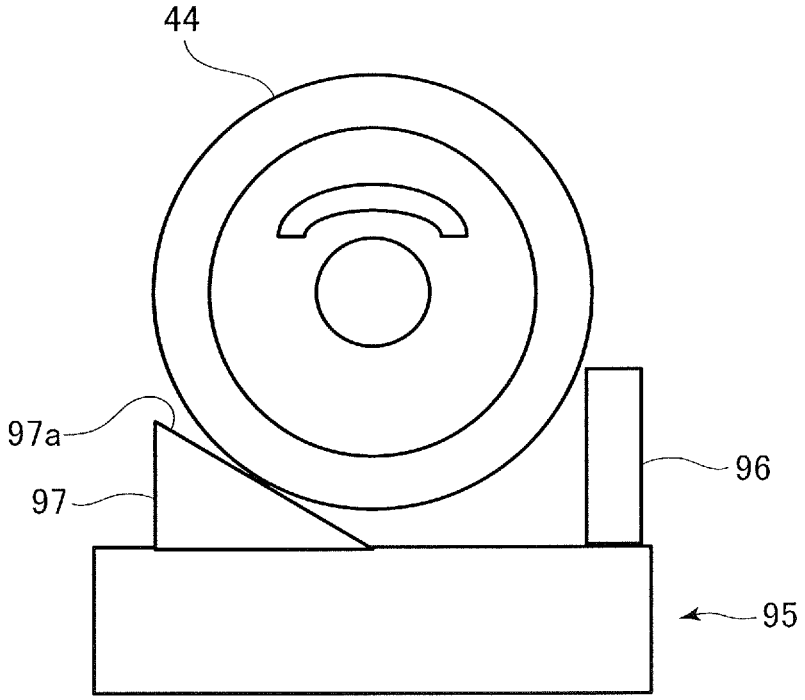
FIG. 7 is a side view of first and second ribs in a modified example viewed from downstream in the forward direction.

While the first through third embodiments are configured to have either one of the circular arc roller placing surface 81, the V-shaped roller placing surface 86 and the first and second ribs 91*a* and 91*b* as the roller supporting base, the present disclosure is not limited to them. For instance, as illustrated in FIG. 7, a roller supporting base 95 may include two different ribs 96 and 97 capable of supporting the retard roller 44, one rib 97 may be configured to have a slope 97*a* contactable with the retard roller 44. Such ribs 96 and 97 are also exemplary first and second contact portions in contact with the outer circumferential surface of the roller member respectively at different positions in the direction intersecting with the attaching direction. The roller supporting base is not also limited to those of the present embodiment in terms of the shapes of the roller placing surface and the ribs as long as the opening end 61 of the retard roller 44 supported by the roller supporting base overlaps with the free end 74 when viewed from downstream in the forward direction "Dout".

While the examples in which the retard roller 44 is supported by the roller bases 80, 85 and 90 in the first through third embodiments, the present disclosure is not limited to such examples. For instance, either of the pickup roller 42, the feed roller 43, the registration roller pair 51 and the discharge roller pair 52 may be supported by the roller supporting base 80, 85 or 90. That is, these rollers are one example of the "roller member" of the present disclosure.

Still further, while the rotation shaft 73 and the communicating hole portion 63 are tapered, respectively, in the printer 100 of the first through third embodiments, the present disclosure is not limited to such configurations. The rotation shaft 73 and the communicating hole portion 63 may not be tapered, or only either one may be tapered.

While the upstream end in the forward direction "Dout" of the roller placing surface or the rib are disposed downstream in the forward direction "Dout" of the free end 74 in the printer 100 of the first through third embodiments, the present disclosure is not limited to such configuration. For instance, the roller placing surface or the rib may be configured such the upstream end in the forward direction "Dout" is disposed upstream of the free end 74. Still further, the roller supporting base 80, 85 and 90 may be provided not in the separation holder 58, but in the frame portion 70. In this case, the abovementioned positional relationship between the retard roller 44 supported by the roller supporting bases 80, 85 and 90 and the rotation shaft 73 is met at a separate position where the separation holder 58 is separated from the feed roller 43.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-129520, filed on Jul. 6, 2018, which is hereby incorporated by reference herein in its entirety.

What is claimed is:

1. A sheet conveyance apparatus comprising:

a shaft portion supported by an apparatus body;

a roller member comprising an outer circumferential surface to contact the sheet and a hole portion, having an opening, to which the shaft portion is fitted, wherein the roller member is attached to the shaft portion through the opening along an axial line of the shaft portion; and a guide configured to guide the roller member in an attachment operation of the roller member to the shaft portion, wherein at least a part of the guide is located upstream of an end of the shaft portion in an attaching direction of the roller member, and wherein the guide is configured to guide the roller member such that a distance between rotation axes of the roller member and the shaft portion is smaller than a difference between a radius of the opening and a radius of the end of the shaft portion in a state where the outer circumferential surface of the roller member is in contact with the guide at a position upstream of the end of the shaft portion in the attaching direction.

2. The sheet conveyance apparatus according to claim 1, wherein the end of the shaft portion is circular when viewed in the attaching direction, and wherein the opening of the roller member is circular having a radius larger than the end of the shaft portion when viewed in the attaching direction.

3. The sheet conveyance apparatus according to claim 1, wherein the shaft portion comprises a tapered portion of which an outer diameter reduces as the tapered portion extends from downstream to upstream in the attaching direction toward the end.

4. The sheet conveyance apparatus according to claim 1, wherein the hole portion comprises a tapered portion of which an inner diameter is enlarged as the tapered portion extends from upstream to downstream in the attaching direction toward the opening.

5. The sheet conveyance apparatus according to claim 1, wherein the guide is configured to support a weight of the roller member that is not attached to the shaft portion while keeping a rotation axis of the roller member supported on the guide lower than a rotation axis of the shaft portion in a gravity direction.

6. The sheet conveyance apparatus according to claim 1, wherein a downstream end of the guide in the attaching direction is located upstream of and separated from the end of the shaft portion in the attaching direction, and wherein a distance in the attaching direction between the downstream end of the guide and the end of the shaft portion is shorter than a half of a length of the roller member in the attaching direction.

7. The sheet conveyance apparatus according to claim 1, wherein an upstream end of the guide in the attaching direction extends upstream in the attaching direction farther than the end of the shaft portion by a length of the roller member in the attaching direction or more.

8. The sheet conveyance apparatus according to claim 1, wherein the guide comprises a concave surface curved along the outer circumferential surface of the roller member when viewed in the attaching direction.

9. The sheet conveyance apparatus according to claim 8, wherein the concave surface is a circular arc having a diameter greater than an outer diameter of the roller member when viewed in the attaching direction.

10. The sheet conveyance apparatus according to claim 8, wherein a distance between both end portions in a direction intersecting with the attaching direction of the concave surface is greater than a radius of the shaft portion.

11. The sheet conveyance apparatus according to claim 1, wherein the guide comprises a first contact portion and a second contact portion configured to be in contact with the outer circumferential surface of the roller member at different positions in a direction intersecting with the attaching direction.

12. The sheet conveyance apparatus according to claim 11, wherein the first and second contact portions are two planes disposed in a V-shape when viewed in the attaching direction.

13. The sheet conveyance apparatus according to claim 11, wherein the first and second contact portions are two ribs provided apart from each other in the direction intersecting with the attaching direction and extending along the attaching direction.

14. The sheet conveyance apparatus according to claim 11, wherein a distance, between a position where the first contact portion contacts with the outer circumferential surface of the roller member and a position where the second contact portion contacts with the outer circumferential surface of the roller member, is greater than a radius of the shaft portion.

15. The sheet conveyance apparatus according to claim 1, further comprising a feed roller configured to feed a sheet, wherein the roller member is disposed in contact with the feed roller and is configured to separate the sheet fed by the feed roller from another sheet by applying a frictional force to the another sheet entering a nip portion formed between the feed roller and the roller member.

16. The sheet conveyance apparatus according to claim 1, wherein the roller member comprises a manipulator to be manipulated from an upstream side in the attaching direction, and wherein the roller member is attached to the shaft portion by pushing the roller member downstream in the attaching direction to a predetermined position, and is pulled out upstream in the attaching direction from the predetermined position by manipulating the manipulator.

17. The sheet conveyance apparatus according to claim 1, wherein the guide is fixed to a frame of the apparatus body.

18. The sheet conveyance apparatus according to claim 1, further comprising a holder configured to support the shaft portion at a position in the attaching direction downstream of a position where the roller member is attached, wherein the holder is movably supported by the apparatus body, and wherein the guide is provided on the holder.

19. An image forming apparatus comprising:

a sheet conveyance apparatus configured to convey a sheet; and an image forming portion configured to form an image on the sheet conveyed by the sheet conveyance apparatus, wherein the sheet conveyance apparatus comprises:

a shaft portion supported by an apparatus body;

a roller member comprising an outer circumferential surface to contact the sheet and a hole portion, having an opening, to which the shaft portion is fitted, wherein the roller member is attached to the shaft portion through the opening along an axial line of the shaft portion; and a guide configured to guide the roller member in an attachment operation of the roller member to the shaft portion, wherein at least a part of the guide is located upstream of an end of the shaft portion in an attaching direction of the roller member, and wherein the guide is configured to guide the roller member such that a distance between rotation axes of the roller member and the shaft portion is smaller than a difference between a radius of the opening and a radius of the end of the shaft portion in a state where the outer circumferential surface of the roller member is in contact with the guide at a position upstream of the end of the shaft portion in the attaching direction.

20. A sheet conveyance apparatus comprising:

a shaft portion supported by an apparatus body;

a roller member comprising an outer circumferential surface to contact the sheet and a hole portion, having an opening, to which the shaft portion is fitted, wherein the roller member is attached to the shaft portion through the opening along an axial line of the shaft portion; and a guide configured to guide the roller member in an attachment operation of the roller member to the shaft portion, wherein at least a part of the guide is located upstream of an end of the shaft portion in an attaching direction of the roller member, and wherein the guide is configured to guide the roller member such that the end of the shaft portion is located inside the opening of the roller member when viewed in the attaching direction in a state where the outer circumferential surface of the roller member is in contact with the guide at a position upstream of the end of the shaft portion in the attaching direction, wherein the guide is configured to support a weight of the roller member that is not attached to the shaft portion while keeping a rotation axis of the roller member supported on the guide lower than a rotation axis of the shaft portion in a gravity direction.

* * * * *